United States Patent [19]

Olsen

[11] 4,443,131

[45] Apr. 17, 1984

[54] METHOD FOR CONSTRUCTING AN OFFSHORE PLATFORM STRUCTURE HAVING A PLURALITY OF SUPPORTING LEGS INCLINED INWARDLY TOWARDS EACH OTHER

[75] Inventor: Olav Olsen, Oslo, Norway

[73] Assignees: Ingeniør Thor Furuholmen A/S; A/S Høyer-Ellefsen; Ingeniør F. Selmer A/S, all of Oslo, Norway

[21] Appl. No.: 354,533

[22] Filed: Mar. 4, 1982

[51] Int. Cl.[3] ..... E02B 17/00

[52] U.S. Cl. ..... 405/203; 405/195; 405/222

[58] Field of Search ..... 405/195, 203–208, 405/222, 223; 114/264, 265

[56] References Cited

U.S. PATENT DOCUMENTS

| | | | |
|---|---|---|---|
| Re. 29,413 | 9/1977 | Hekkanen et al. | 405/204 |
| 2,775,095 | 12/1956 | Harris | 405/204 |
| 2,972,234 | 2/1961 | Suderow | 405/209 X |
| 3,537,268 | 11/1970 | Georgii | 405/205 |
| 3,618,327 | 11/1971 | Frein et al. | 405/205 |
| 4,043,138 | 8/1977 | Stageboe et al. | 405/205 |
| 4,106,302 | 8/1978 | Vogel | 405/205 X |

*Primary Examiner*—Dennis L. Taylor

*Attorney, Agent, or Firm*—Fleit, Jacobson, Cohn & Price

[57] ABSTRACT

A method for constructing an offshore platform structure having a plurality of supporting legs inclined inwardly towards each other is disclosed. The entire structure may be constructed in a dry dock, or optionally the lower raft may be constructed in the dry dock and then towed out to a deep water site where the structure is completed. The platform foundation includes a plurality of foundation footings and the lower end of the inclined supporting legs are built in the dry dock. The legs are cast in vertical position using conventional slip forms. Subsequent to the termination of the casting of the inclined legs the supporting legs are tilted towards each other and permanently interconnected at their upper ends. At their lower ends the legs are permanently anchored to the foundation footings. Remaining sections of the legs, if any, may then be cast in any conventional manner, preferably using slip forming.

10 Claims, 9 Drawing Figures

METHOD FOR CONSTRUCTING AN OFFSHORE PLATFORM STRUCTURE HAVING A PLURALITY OF SUPPORTING LEGS INCLINED INWARDLY TOWARDS EACH OTHER

BACKGROUND OF THE INVENTION

1. Field of the Invention

The present invention relates to a method for constructing an offshore platform structure having inclined supporting legs.

2. Prior Arts

Concrete platform structures having inclined supporting legs are commonly known. U.S. Pat. No. 4,043,138 discloses an open frame offshore foundation structure of concrete to be firmly but removably located on a sea floor. The structure comprises a lower set of hollow columns inclined towards each other in direction upwards, a ballastable intertie box structure rigidly receiving the tops of said inclined columns and an upper vertical column unit, the lower ends of which are rigidly connected to the intertie box structure and the upper ends of which are intended to support a deck superstructure in position above the sea level. Both the lower set of inclined columns and the upper vertical columns are cast using slip form, the lower set of inclined columns being cast using inclined slip forms.

Inclined slip forming is substantially more complicated and expensive than casting vertical columns using slip forms. Further, when using the conventional slip forming technique for casting inclined columns it is not possible to vary the diameter of the column during casting. It should further be appreciated that in the conventional slip forming technique for casting inclined legs, the inclination cannot exceed approximately 20° from the vertical. In particular, but not exclusively, such types of platform structures are particularly suitable for depths exceeding 100 meters. As platform structures in general are designed for increasing depths, the lengths of the inclined legs are increased correspondingly. However, since the legs according to the conventional method of construction are rigidly affixed to the foundation even during the construction stage, temporarily arranged provisional supports or stiffeners must be used during the construction phase in order to reduce dynamic stresses imposed on the raft to an acceptable level.

Since the inclination of the legs is limited, the sectional forces appearing in any cross-section of the legs when installed on the site will be excessive unless ballast is added to improve the stability of the structure. Consequently, both construction and installation work become complicated and more costly. If the inclination is increased, the area of the dry dock must be increased correspondingly. The same considerations apply to platform structures designed for great depths.

THE PURPOSES OF THE INVENTION

A main object of the present invention is to provide a new method for constructing offshore platform structures, in particular for great depths, eliminating the disadvantages and limitations described above.

SUMMARY OF THE INVENTION

According to the present invention at least the foundation and a lower section of the supporting legs of the platform structure are constructed in a dry dock, the legs being cast in vertical position. The entire structure may be constructed in the dry dock. Optionally, only the lower section of the platform structure is constructed in a dry dock, the raft being completed at a deep water site. It should be appreciated that in both cases the legs are cast in vertical position, preferably by means of slip forming.

Subsequent to the termination of the casting of the legs, the legs are tilted towards each other and permanently interconnected at their upper ends. The lower ends of the legs are further affixed to the foundation, providing a rigid interconnection. Further vertical legs may be constructed on top of said interconnected inclined legs, if required or desirable, preferably using slip forming or in any conventional ways.

The bottom portions of the support legs may be equipped with a curved cradle-shaped plate or surface having a suitable radius of curvature, said radius of curvature preferably corresponding to the distance from said plate to the center of gravity of the leg. Alternatively, each leg and its footing are interconnected at their lower end by means of intertying rigid structures, each leg and its footing being hinged to said rigid structure during the construction stage and rigidly interconnected subsequent to the tilting operations.

According to a further embodiment of the present invention the legs may be cast at least in two separate steps, adjusting the verticality between the steps, providing inclined legs consisting of at least two portions having different inclination when in a completed state.

The inclined legs may be interconnected by means of an intertying structure arranged in the middle region of the completed platform structure.

Since the construction is based on slip forming vertical sections, the cross sectional area of the legs may be dimensioned to meet the requirements of sufficient displacement volume, stability in the floating state, and sufficient wall thickness and cross sectional area to accommodate shear stress and moments appearing in the legs and in an economic way.

Since there exist no restrictions with respect to the maximum inclination water may be used as ballast, avoiding the dependency on ballast in the solid form with a large specific weight, such as and for instance, sand. Consequently, the design will be less complicated, improving the economy of the structure as a consequence thereof.

According to the present invention another major improvement is achieved in that the inclination of the legs may be changed during the slip forming stage, if required or deemed necessary, without complication the construction work to any substantial degree.

BRIEF DESCRIPTION OF THE DRAWINGS

A preferred embodiment of the present invention shall be further described with reference to the attached drawings, wherein.

DESCRIPTION OF THE PREFERRED EMBODIMENTS

Figure 1:
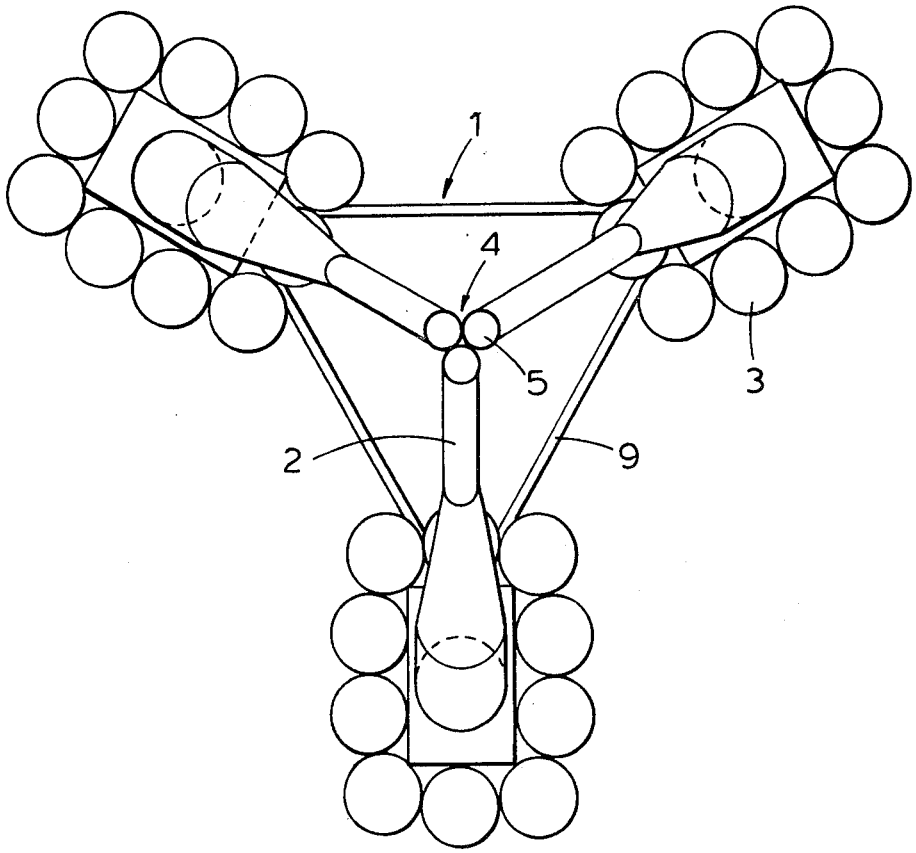
FIG. 1 shows a horizontal view of a platform structure intended to be installed on sites with depths less than approximately 150 meters.
Figure 2:
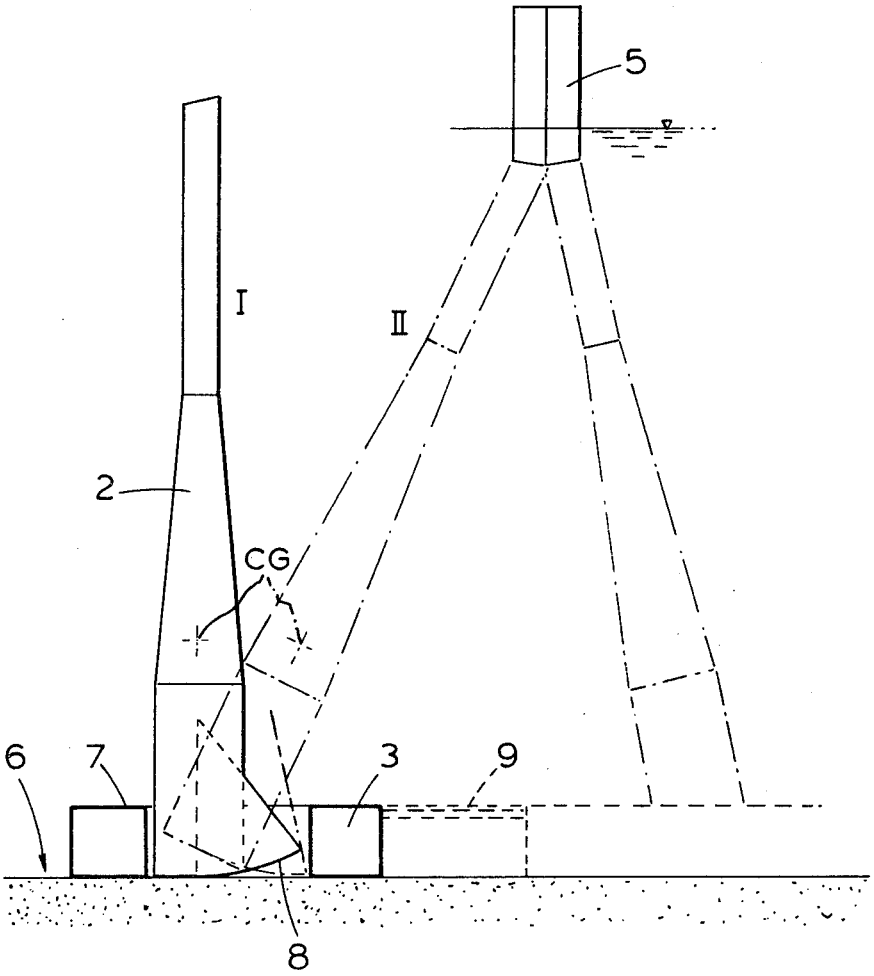
FIG. 2 shows two stages of construction, one of which being shown in dotted lines.
Figure 3A:
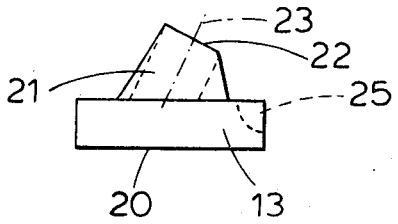
FIG. 3*a* shows in more detail a vertical elevation of a footing and the lower end of a leg according to a second embodiment of the present invention.
Figure 3B:
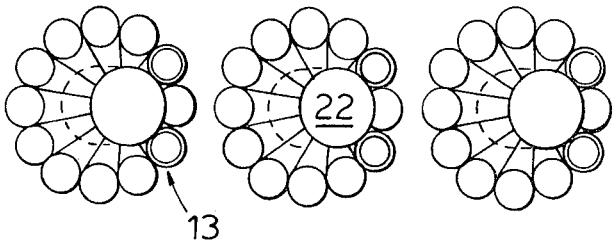
FIG. 3*b* shows a horizontal view of three footing towers cast in the dry dock.
Figure 3C:
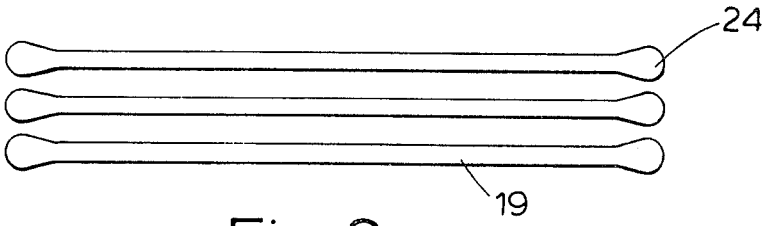
FIG. 3c shows three connecting braces intended to interconnect the footing towers shown in FIG. 3b, the braces being cast in the dry dock, preferably together with the footing towers.
Figure 4:
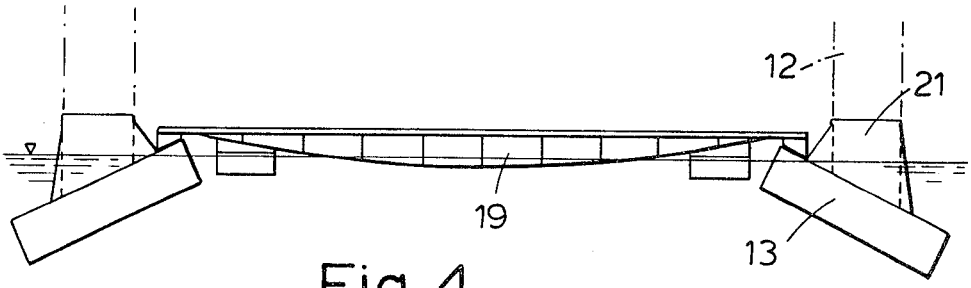
FIG. 4 shows a vertical elevation of two footing towers, interconnected by a connecting braces, the raft being shown in a floating state, anchored to the sea bed by means of anchor chains.
Figure 5:
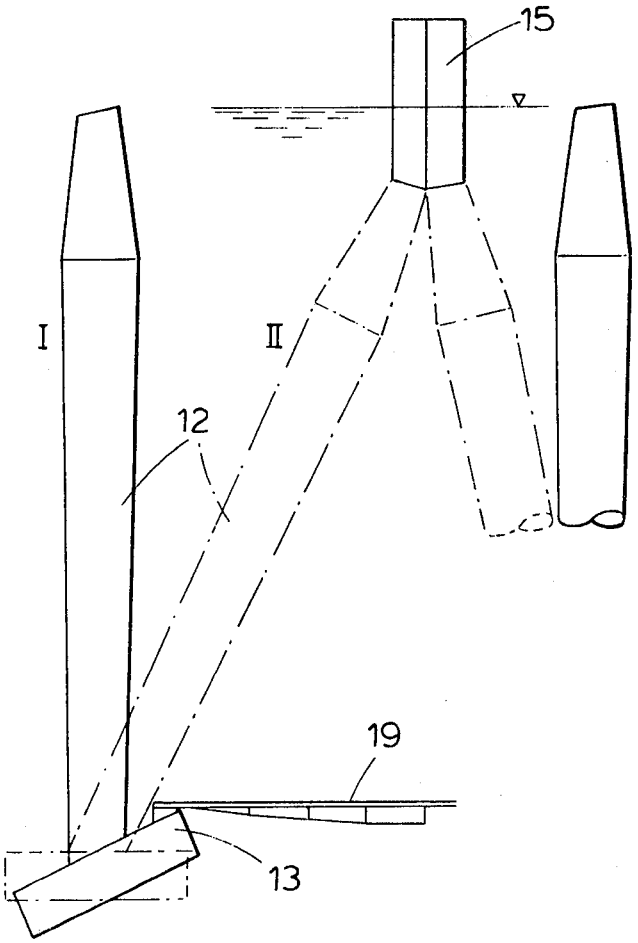
FIG. 5 shows a vertical elevation of two stages of construction of the embodiment shown in FIGS. 3a–3c and 4, one stage being indicated by dotted lines.
Figure 6:
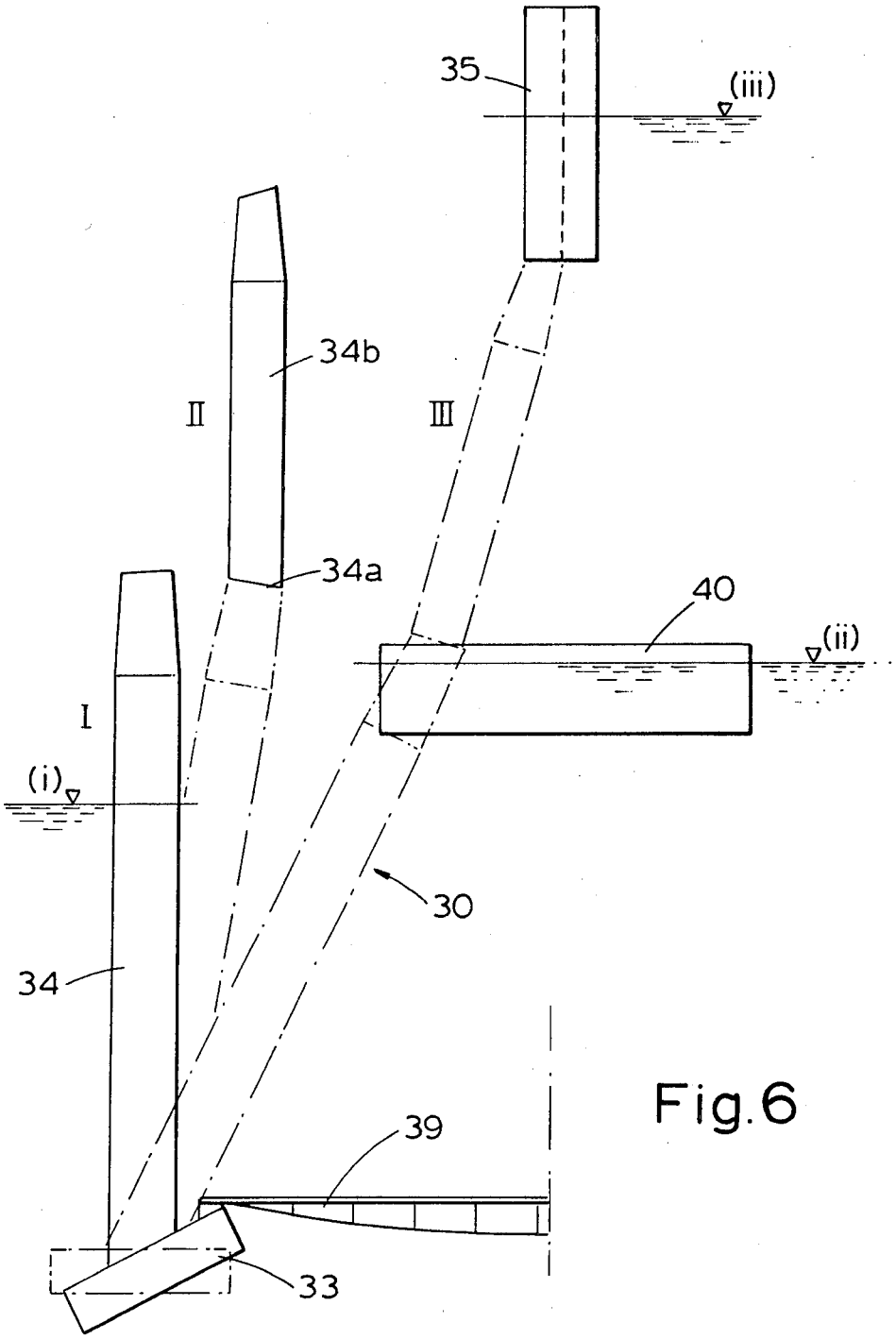
FIG. 6 shows a vertical elevation of two constructional stages for a third embodiment of the present invention, one stage being indicated by dotted lines.
Figure 7:
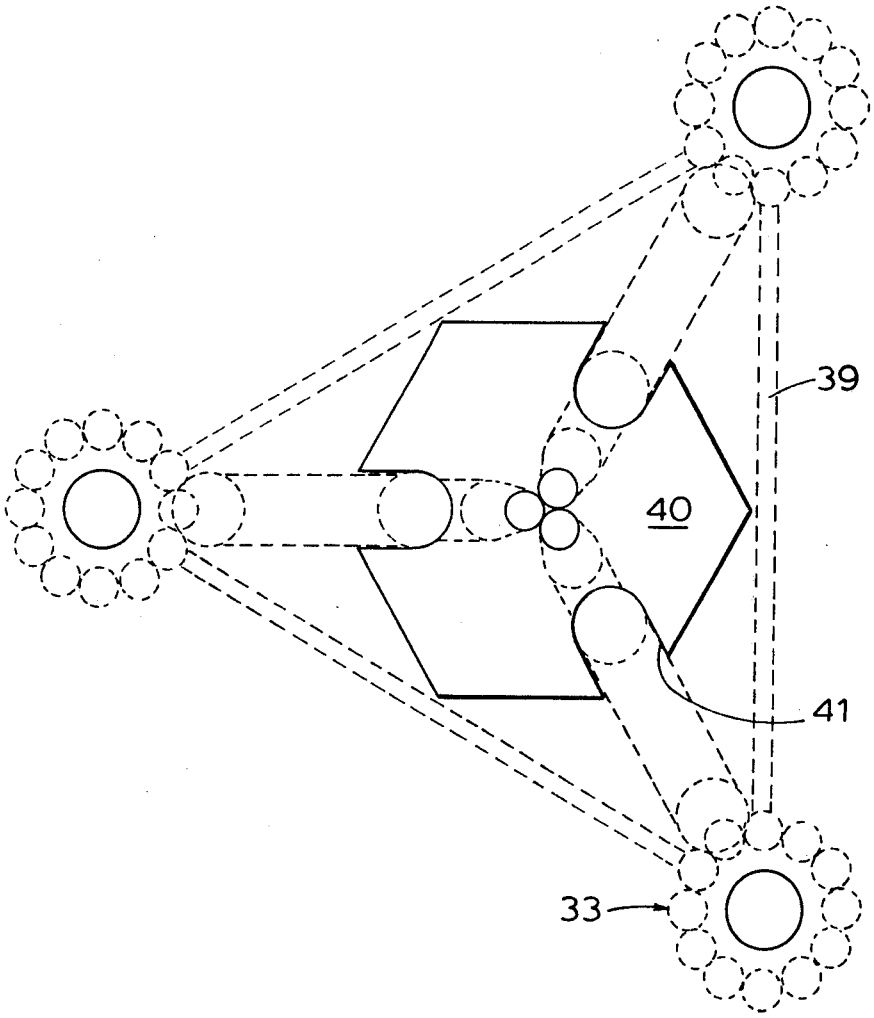
FIG. 7 shows a horizontal view of a completed platform structure in accordance with the embodiment shown in FIG. 6.

The solution shown in FIGS. 1 and 2 is particularly suitable for depths down to approximately 150 meters, the embodiment shown in FIGS. 3–5 has depths down to 250 meters, in particular in the region 150 m–250 m, while FIGS. 6 and 7 show an embodiment intended for even greater depths, such as down to 400 meters.

FIG. 1 shows schematically a horizontal elevation of an offshore platform structure having three foundation legs 2, each of which has at its lower end a footing structure 3. The foundation legs 2 are inclined towards each other in an upward direction, the inclined legs 2 being interconnected at their upper section. The interconnected portion coincides with the axis of symmetry of the platform structure, forming an upper portion 4 comprising vertical columns 5. The three footing structures 3 are designed so as to enable them to float when towed out of the dock. If the entire deck is constructed in the dry dock, said footing structure and, optionally, the lower intertying portions 9 are given sufficient buoyancy to allow the platform to be towed in an upright position out of the dry dock, with a draft less than the minimum depth available. FIG. 2 shows two steps of the method according to the present invention for constructing the structure shown in FIG. 1. The bed of the dry dock is denoted by the reference numeral 6. First, the footing structures 3 are constructed, using any known construction techniques per se. The footing structures may be prebuilt and transported into the required position in the dock, or the footing structures may be cast in situ. The intertying, lower structure 9 is then constructed and built-in in the footing structure 3. Said intertying structure may also either be prebuilt and transported to its proper position between the footing structures, or said ties may be cast in situ. The footing structures 3 are provided with a centrally arranged open topped section. The supporting legs 2 are cast in an upright, vertical position, depending preferably on slip forming. The supporting legs are in situ, the legs 2 being positioned in said centrally arranged open topped section of the footing structure 3. Each supporting leg is at its bottom portion provided with a cradle-shaped body 8 of steel or concrete or a combination thereof. Said cradle-shaped body 8 has a curved surface, the radius of curvature of which corresponding to the distance between the curved surface and the center of gravity of supporting leg 2. When the portions of the leg intended to be inclined are completed, the legs 2 are tilted inwardly till they meet centrally. Since the radius of curvature of the lower surface corresponds to the distance between said curved surface and the center of gravity the weight of each leg will at any time during tilting phase act on the portion of the curved surface being in contact with the supporting bottom surface of the open topped section of the footing structure. In the tilted position the lower end of each leg is rigidly affixed to the footing structure, preferably by prestressing cables and conventional reinforcement and subsequently by pouring concrete into the voids around the lower ends of the legs. The construction of the vertical column portion 5 on top of the inclined legs may now be carried out in any conventional manner. The stage where the legs are in their untilted, vertical position is shown by the solid lines, while the inclined state is indicated by dotted lines. Further, only one, solid line column and two dotted line columns or legs 2 are shown in FIG. 2.

FIGS. 3, 4 and 5 show various components of the footing structure 3 and the intertying members 19 according to a second preferred embodiment of the present invention. The FIGS. 4 and 5 show further two different stages in the construction procedure. The embodiment disclosed in FIGS. 3–5 is particularly, but not exclusively, suitable for greater depths, such as down to approximately 250 meters. According to this embodiment the foundation footings 13 are constructed separately and independently in the dry dock. FIG. 3a shows a side view of a footing structure 13, while FIG. 3c shows a horizontal view of the three intertying sections 19 in the form of girders, etc., intended in the final stage to rigidly interconnect the three footing structures 13. FIG. 3b shows a horizontal view of the footing structures.

Each footing structure 13 is provided with a horizontal base plate 20 of concrete and an abutment portion 21 affixed to the base plate 20. The axis of symmetry 23 of the abutment portion 21 is inclined with respect to the base plate, the indication corresponding to the final indication of the legs 12 when in completed tilted position. The abutment portion is at its upper end provided with a top surface 22 perpendicularly arranged with respect to said axis of symmetry 23.

The girders 19 shown in FIG. 3c may optionally be provided with ends having a ball joint shape 24, while the footing structures may be provided with corresponding spherical or cylindrical ballshaped recesses or depressions for the ball joints 24 or optionally for cylinder joints 24.

Subsequently, upon the completion of the construction work in the dry dock the raft is towed to a deep water site where the remaining part of the structure is constructed. Optionally, the footing structures and the intertying girders are towed separately out of the dry dock and interconnected at the deep water site, ball joint ends of the intertying girders being arranged in the corresponding recesses or depressions 25 in the foundation footings, cfr. FIG. 3a. The footing structures, which are anchored to the sea bed, and which now are interconnected by means of the girders, are trimmed by adding and/or removing ballast from their ballast cells, providing tilting of the footing structure with respect to the girders, the ball joint 24,25 serving as a hinge. The footing structures are tilted until the axis of symmetry 23 of the abutment portion becomes vertical. The legs may now be constructed in a vertical direction, preferably using vertical slip forming. Such a construction stage is shown in FIG. 4. The girders 19 may either have sufficient buoyancy to be self-floating, or they may be temporarily supported by barges or corresponding buoyancy means.

Once the required height of the inclined legs have been achieved the vertical legs are tilted towards each other until they meet in a central position and then are rigidly interconnected. During the tilting stage, the ball joints between the footing structures 20 and the girders 19 once more serve as hinges allowing such relative motion.

The tilting effect is achieved preferably by manipulating the buoyancy of each leg, adding and/or removing ballast. Subsequent to the tilting operation the footing structures 20 are rigidly interconnected to the girders 19 by means of prestressing cables and reinforcement, and by addition of grouting material in the voids around said ball joints. Pipes for supplying said grouting material have been installed in advance.

In FIG. 5 the structure shown in solid lines shows the supporting legs 12 in their vertical constructional position I while the dotted lines show the supporting legs 12 subsequent to the tilting operation in their inclined position II. Once the legs are rigidly interconnected the upper special column portion 15 of the structure may be constructed.

FIGS. 6 and 7 illustrate a third platform embodiment particularly designed for depths down to 400 meters. The foundation footings 33, support legs 34,35 and girders 39 are constructed as described above with reference to FIGS. 3–5. Further, a buoyancy structure 40 is constructed in the dry dock, preferably simultaneously with the casting of the girders 39 and/or the footings 33, the buoyancy structure being intended to serve as an intertying structure intertying the upper ends of the inclined legs 34,35. The purpose of said buoyancy structure will be described in further details below.

In case of very high platform structures intended for deep waters the stability of the structure during towing to the offshore site is a main concern since the maximum towing draft is limited, at least during touring inshore. For example at, a preferred towing route in Norway for towing platform structures out from the construction site to the offshore site, the maximum allowable touring draft is limited to approximately 220 meters. In case of tall platform structures, and in particular for structures being provided with a deck superstructure on which substantial pay load is arranged, extra temporarily arranged or permanently arranged buoyancy tanks are required in the vicinity of the touring water line during tow out.

According to the embodiment shown in FIGS. 6 and 7 said intertying buoyancy tank 40 serves the purpose of the additional buoyancy described in the paragraph above. In addition, said tank 40 serves as an intermediate intertying member, intertying the legs 34. The tank 40 has a polygonal cross-sectional area and is provided with recesses, the positions and dimensions of which correspond to the positions and dimensions of the legs 34 in the touring water line. The legs may either be given a shape as shown in FIG. 5 or a shape as shown in FIG. 6.

According to the embodiment shown in FIG. 6, the lower portion of the leg 34 having one inclination up to the region for the touring water line and a second different inclination above the touring water line. The lower portion is cast in vertical position, denoted as position I, whereafter the leg is partly tilted to an intermediate position II for further casting in vertical direction of the upper section **34*b* of the legs. In this manner the leg is provided with a bend or knee section 34*a* which preferably is positioned at a level corresponding to the position of the buoyancy tank 40** when the legs subsequently are tilted to their ultimate position III where the legs are rigidly interconnected. Subsequent to the establishing of a rigid interconnection at their upper end and in the intermediate position, the girders are rigidly affixed to the footing structures. The casting of the upper vertical column portion may now be done.

Obviously, it is feasible to tilt the legs 34 shown in FIG. 6 to position II, rigidly interconnect the floating body 40 to the legs 34 at their upper ends, and then cast the remaining portions of the legs in vertical directions, projecting vertically up from the floating tank 40 in its ultimate shape. The legs 34 will then not meet in a central position, but form separate columns. The buoyancy body will serve as an intertying rigid stiffening body.

The operational procedure described in conjunction with the above disclosed embodiments, may be varied or combined in order to obtain the most efficient and economic method adapted to the local conditions of the construction site and the towing route. In the embodiment shown in FIG. 2 it may be possible to perform the tilting operations in a dry dock. In such a case the dry dock should be filled with water so as to allow the footing structures to tilt with respect to the girders, manipulating with the buoyancy of the footing structures.

If the platform is designed for shallow waters, it may further be feasible to produce the tilting by means of conventional mechanical means. Still further, the footing structure may preferably comprise a plurality of contiguous cells. Several of said cells may be designed as to function as a support for the ends of the separately constructed intertying girders, cfr. FIGS. 5–7.

According to the embodiment shown in FIGS. 6 and 7, the upper inclined portions of the support legs may optionally be cast using inclined slip forms, if deemed desirable.

What we claim is;

1. A method for constructing an offshore platform structure, the platform structure including a foundation on which are supporting platform legs for supporting a platform deck, the method comprising: constructing a foundation body on the bottom of a dry dock; casting supporting legs by slipforming in a vertical direction starting with their lower ends said legs being evenly spaced within the foundation body; tilting the top end portions of the supporting legs towards one another upon completion of casting; connecting the upper end portions of the supporting legs rigidly with one another; rigidly securing the lower ends of the supporting legs to the foundation body; and slipforming a vertical deck support structure on the top of the connected supporting legs, so that the dry dock can be flooded and the structure towed to an offshore location.

2. A method as claimed in claim 1, including casting the legs in open-top sections of the foundation.

3. A method as claimed in claim 2, including shaping the lower ends of the supporting leg with a curved supporting surface having a radius of curvature corresponding to the distance between the curved surface and the center of gravity of the supporting leg.

4. A method according to claim 1, wherein the foundation body is constructed with a foundation footing for each supporting leg and includes substantially horizontal braces rigidly connecting the foundation footings with one another.

5. A method of constructing an offshore platform structure, the platform structure including a foundation on which are supporting platform legs for supporting a platform deck, the method comprising: constructing a foundation body on the bottom of a dry dock; casting supporting legs by slipforming in a vertical direction starting with their lower ends evenly spaced within the foundation body; constructing a buoyancy body located centrally between the supporting legs in the dry dock; flooding the dry dock; tilting the top end portions of the supporting legs towards one another and the buoyancy body; connecting the upper end portions of the supporting legs rigidly with the buoyancy body; connecting the lower ends of the supporting legs rigidly with the foundation body; and constructing a deck support structure on the top of the interconnected supporting legs.

6. A method for constructing an offshore platform structure including a foundation on which are supporting platform legs for supporting a platform deck, the method comprising: constructing a foundation in a dry dock with a separate foundation footing for each of a plurality of supporting legs, the footings being shaped with abutment portions to receive supporting legs; casting supporting legs in a vertical position integrally with the foundation footings and having abutment surfaces extending perpendicularly to the axes thereof; preparing a plurality of braces, each brace having an elongated shape with two end portions; connecting the foundation footings with one another by separate transverse braces; flooding the dock and mounting the braces with their end portions on the foundation footings; adjusting the footings so that their leg abutment surfaces extend substantially horizontally; tilting the supporting legs inwardly towards each other; and joining the braces rigidly with the foundation footings.

7. A method as claimed in claim 6, wherein the support leg footings are shaped with tilt bearings for the end portions of the braces.

8. A method according to claim 6, wherein the supporting legs are cast in at least two steps, comprising adjusting the legs and thereby the inclination angle of the legs to change the inclination between the casting operation steps, the last casting operation step being carred out in a vertical position before tilting the legs towards each other and joining at the upper ends thereof.

9. A method as claimed in claim 6, including casting a buoyancy body in the dock and locating it between the supporting legs to increase the buoyancy of the supporting leg structure, and joining the buoyancy body permanently with the supporting legs.

10. A method as claimed in claim 9, wherein the buoyancy body includes abutment means and guiding means for temporarily receiving the supporting legs during casting.

* * * * *